United States Patent [19]

Strout et al.

[11] Patent Number: 4,575,020

[45] Date of Patent: Mar. 11, 1986

[54] PORTABLE CHUCK FOR DISPENSING WRAPPING MATERIAL

[75] Inventors: Russell B. Strout, Winchester; Jerold J. Golner, Lowell, both of Mass.

[73] Assignee: Borden, Inc., Columbus, Ohio

[21] Appl. No.: 478,499

[22] Filed: Mar. 24, 1983

[51] Int. Cl.[4] ..... B65H 23/06

[52] U.S. Cl. ..... 242/96; 242/99; 53/556; 53/587

[58] Field of Search ..... 242/96, 99, 75.4, 68.2, 242/72 R, 68.4, 129.51; 53/556, 587, 390; 156/577, 579

[56] References Cited

U.S. PATENT DOCUMENTS

| | | | |
|---|---|---|---|
| 1,067,643 | 7/1913 | Christner et al. | 242/99 |
| 1,110,136 | 9/1914 | Hundhausen | 242/72 |
| 1,411,292 | 4/1922 | Mueller | 242/68.2 |
| 1,915,238 | 6/1933 | Mosher et al. . | |
| 2,651,479 | 9/1953 | Bauer | 242/129.51 |
| 2,702,972 | 3/1955 | Denton . | |
| 2,961,184 | 11/1960 | Alford | 242/99 |
| 3,093,943 | 6/1963 | Kazimir . | |
| 3,361,382 | 1/1968 | Converse . | |
| 4,045,038 | 8/1977 | Obenshain | 242/68.4 X |
| 4,102,513 | 7/1978 | Guard . | |
| 4,155,589 | 9/1979 | Hoover et al. . | |
| 4,179,081 | 12/1979 | Parry . | |
| 4,209,961 | 7/1980 | Donnelley . | |
| 4,248,392 | 2/1981 | Parry . | |
| 4,339,022 | 7/1982 | Hoover . | |

OTHER PUBLICATIONS

Advertisement entitled "Linear X Grippers", of Linear Films, Inc., advertised at Packaging Machinery Manufacturers Institute Show, Chicago, Ill., Nov. 1982.

Advertisement entitled "Pallet Guard Stretch Wrap Film", manufactured by Stevenson Industries, Inc., Chatsworth, Calif.

*Primary Examiner*—John M. Jillions

*Attorney, Agent, or Firm*—Frank E. Robbins; George P. Maskas

[57] ABSTRACT

A portable chuck for dispensing under tension a roll of wrapping material wound about a tubular core is disclosed herein. The portable chuck includes an expandable spindle insertable within one end of the tubular core, and a handle for selectively expanding the spindle so as to create a braking force between the outside surface of the expandable spindle and the inside surface of the tubular core. The chuck is formed from first and second chuck pieces, each of which includes a semicylindrical spindle portion, collar, and handle portion. The fulcrum means is disposed between the first and second adjacent chuck pieces above the collar of each for allowing a relative rocking motion between the first and second adjacent chuck pieces, whereby the spindle portions are drawn away from one another at a mechanical advantage as the handle portions are manually squeezed toward one another.

12 Claims, 5 Drawing Figures

PORTABLE CHUCK FOR DISPENSING WRAPPING MATERIAL

BACKGROUND OF THE INVENTION

1. Field of the Invention

The invention generally relates to a hand operated, portable chuck for dispensing under tension a roll of stretch film wrapping material.

2. Description of the Prior Art

High-cling stretch film is used in many types of packaging operations to wrap together a plurality of items or containers. While such stretch films are commonly used to unify stacks of uniformly shaped boxes or containers, the ability of such stretch film to readily conform to a variety of shapes, and cling to a variety of surfaces, has rendered it useful in unifying such diverse articles as sacks, bales, axe bundles, and even mixed loads of different shaped articles. Such film provides a strong, lightweight and transparent bond between the articles or containers wrapped. Moreover, because such film naturally clings to itself as well as a variety of surfaces, the wrapping operation may be conveniently carried out without the need for adhesives.

In most wrapping operations, the stretch film must be applied under tension if it is to properly cling to and bind together a particular group of articles or containers. To achieve such tension, various types of stretch film wrapping dispensers have been developed.

An ideal portable stretch wrap dispenser would be simple in structure and inexpensive to manufacture, but durable enough so that it rarely required maintenance or replacement. Moreover, from the operator's point of view, such a dispenser should be conveniently installable onto a new roll of stretch film, and easily removable from a spent roll. It should also allow the operator to easily and conveniently apply a broad range of tension onto the stretch film during the wrapping process. Finally, the dispenser should be lightweight, so that a minimum of the operator's energy is wasted in lifting and carrying the body of the dispenser.

None of the portable dispensers in the prior art has satisfied all of the foregoing "ideal" criteria. For example, the hand-held film dispenser disclosed in U.S. Pat. No. 4,166,589 (Hoover et al) is relatively complicated in structure, necessitating the manufacture and assembly of nine separate parts. Moreover, because the wrapping tension is controlled by means of twistable handles, the manual operator of this device may be forced to slow down or stop the wrapping operation whenever a tension adjustment necessitates that he twist one or both of the handles more than once. Finally, the hand-held device disclosed in the Hoover et al patent is relatively large and hence weighty, which will accelerate the muscle fatigue of the operator, who must constantly lift and carry the dispenser during the wrapping operation.

The film wrapping dispenser disclosed in U.S. Pat. No. 4,102,513 (Guard) is similarly complicated in structure, and relatively complicated to fabricate. While the tension control on this dispenser appears somewhat more convenient for the operator to use during a wrapping operation, the device as a whole is again large and weighty. Additionally, the installation of a new roll of stretch film on this device inconveniently requires the operator to unscrew an operating handle through many revolutions.

While the film wrapping dispenser disclosed in U.S. Pat. No. 4,339,022, is somewhat less complicated in structure, this dispenser inconveniently requires a source of pressurized air to power the braking action it may apply to the roll of stretch wrap film during the wrapping operation.

The wrapping dispensers disclosed in U.S. Pat. Nos. 4,179,081 and 4,248,392 (both by Parry) do provide dispensers which are comparatively simple in structure. But even these mechanisms are not without shortcomings. As stated in the specifications of each, the tension-adjusting handgrips of both of these devices must be manufactured to a "close fit" between the grip and the insertable adapter or core which is inserted in the tube that the film is wrapped upon. Such tolerances increase the effort required to manufacture these devices, and hence the cost. Moreover, because these handgrips are formed from a flexible material, they are likely to require periodic replacement due to the high degree of friction between the flexible inner surface of the grip, and the outer surface of the insertable adapters. Finally, because there is little or no mechanical advantage associated with the braking actions of each of these devices, they require a relatively great amount of hand-squeezing by the operator, which is fatiguing.

Clearly, a need exists for a film wrapping dispenser which is simple in structure, inexpensive to manufacture, easy and convenient to use, and which requires a minimum amount of maintenance or replacement.

SUMMARY OF THE INVENTION

In its broadest scope, the invention relates to a portable chuck for dispensing under tension a roll of wrapping material wound about a tubular core which includes an expandable spindle insertable within one end of the tubular core, and a handle for selectively expanding the spindle so as to create a braking force between the outside surface of the expandable spindle and the inside surface of the tubular core.

The portable chuck may be formed from first and second chuck pieces, each of which includes a semi-cylindrical spindle portion, collar, and handle portion. A fulcrum means may be disposed between the first and second adjacent chuck pieces above the collar of each for allowing a relative rocking motion between the first and second adjacent chuck pieces, whereby said spindle portions are drawn away from one another at a substantial mechanical advantage when the handle portions are manually squeezed toward one another.

The portable chuck may further include a biasing means for biasing said handle portions toward one another, so that the spindle portions of the first and second chuck pieces will be biased against the interior surface of the tubular core when the chuck is inserted into the core, thereby frictionally preventing the chuck from falling out of the roll of film when the roll is vertically oriented. To further secure the chuck into the roll of film, each of the spindle portions of the chuck pieces may include a recess around their proximal ends for engaging an annular flange or lip which often circumscribes the inner edge of the tubular core.

Each of the spindle portions of the adjacent chuck pieces may further include a radius on its distal end to facilitate the insertion of the chuck into the tubular core. Finally, the handle portions of the adjacent chuck pieces may be beveled around their side edges to prevent the operator from pinching the skin of his hands in the space between the respective handle portions, and beveled along their rear edges to facilitate the manual spreading apart of the bandle portions incident to the process of removing the chuck from a spent roll of film and inserting it into a fresh roll.

In contrast to prior art film dispensers which are either unduly complicated, or have little or no mechanical advantage associated with their braking action, the invention provides a film dispenser which is simple in construction, yet capable of asserting a considerable braking force on a roll of film with only a small amount of hand squeezing.

DETAILED DESCRIPTION OF THE PREFERRED EMBODIMENT

Figure 1:
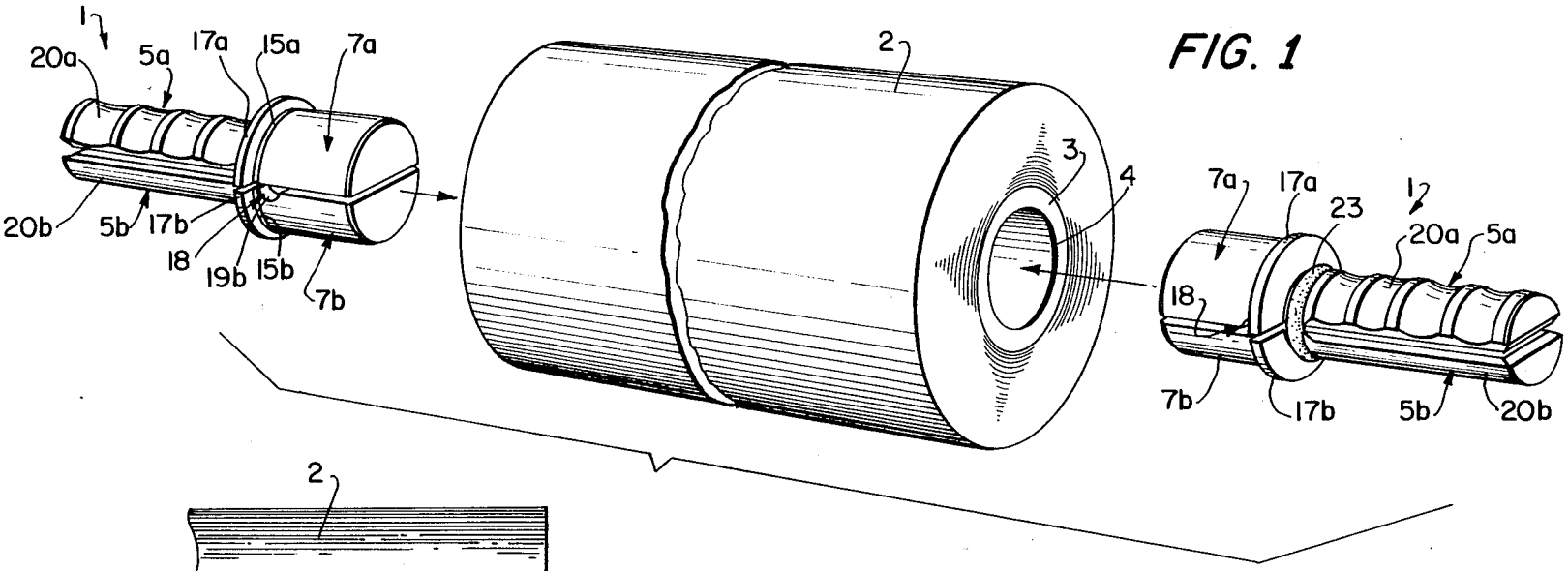
FIG. 1 is a perspective view of a pair of portable chucks of the invention, showing how these chucks may be inserted into the tubular core of a roll of stretchable wrapping film.

With reference now to FIG. 1, the portable chuck of the invention generally includes a knurled chuck piece 5*a* and a smooth chuck piece 5*b* which are fitted together to form each chuck. Two of these chucks 1 are inserted into the ends of a tubular core 3 of a roll 2 of stretch wrap film.

Each chuck piece 5*a*, 5*b* includes a spindle portion 7*a*, 7*b*, a collar 17*a*, 17*b*, and a handle portion 20*a*, 20*b*, respectively. Each of the spindle portions 7*a*, 7*b* is preferably semi-cylindrical in shape so as to form a generally cylindrical spindle when the two chuck pieces 5*a*, 5*b* are fitted adjacent each other in the position illustrated in FIG. 1. Moreover, each of the expandable spindle portions 7*a*, 7*b* is preferably formed from an easily workable but durable material, such as maplewood, since the outer surfaces of these spindle portions 7*a*, 7*b* form the tension control of the invention by frictionally engaging the inner surface of the tubular core 3 when the handle portions 20*a*, 20*b* are squeezed together during a wrapping process, as will be related in more detail hereinafter. It should be noted that each of the spindle portions 7*a*, 7*b* may be integrally formed with its respective chuck piece 5*a*, 5*b* out of a durable plastic material, such as polyethylene.

Figure 5:
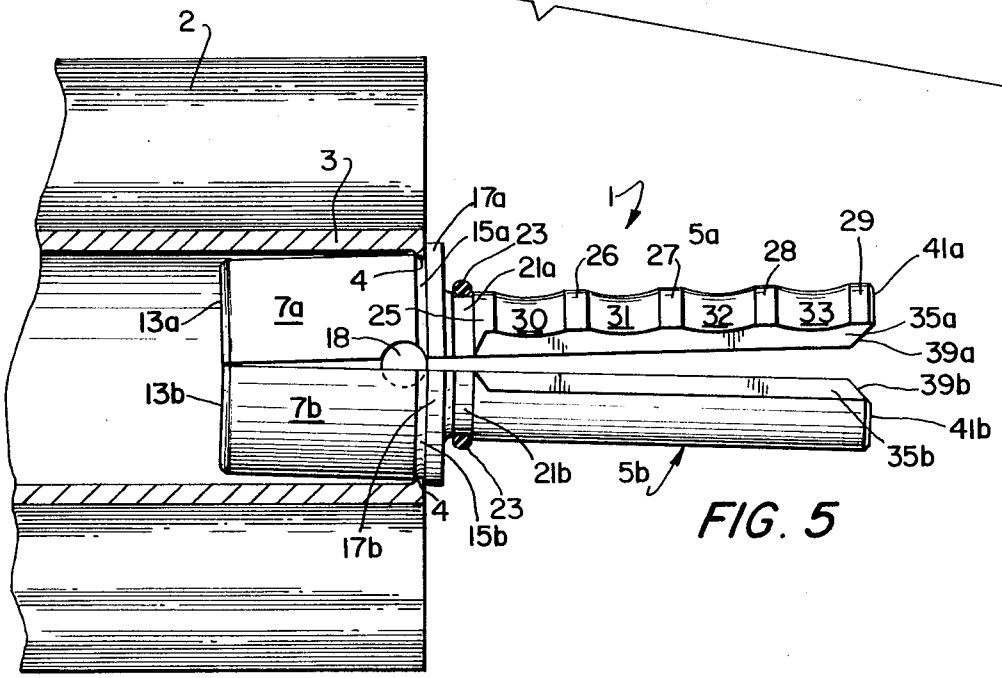
FIG. 5 is a side, partial cross-sectional view of a chuck of the invention in operation in a roll of film.
Figure 2:
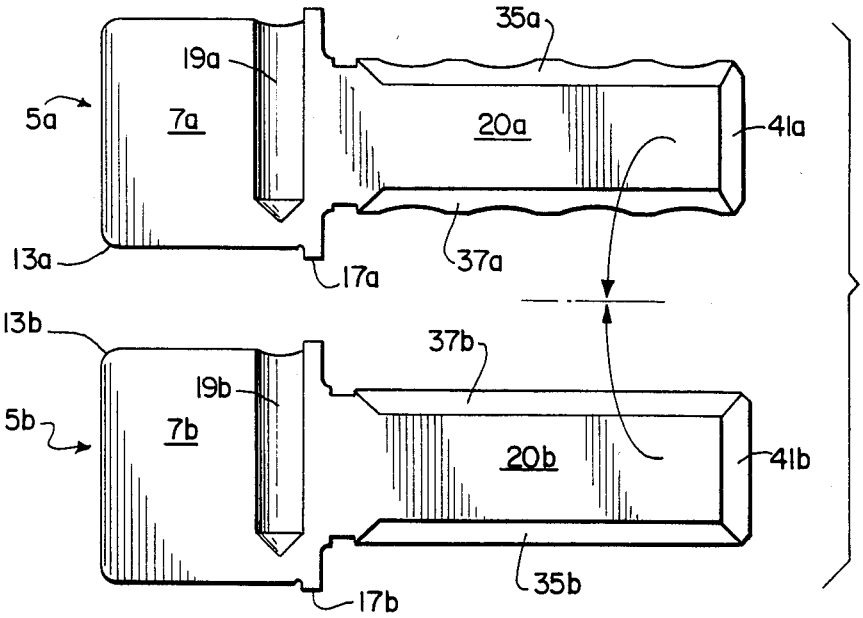
FIG. 2 is a plan view of first and second chuck pieces which form a portable chuck made in accordance with the invention.
Figure 3:
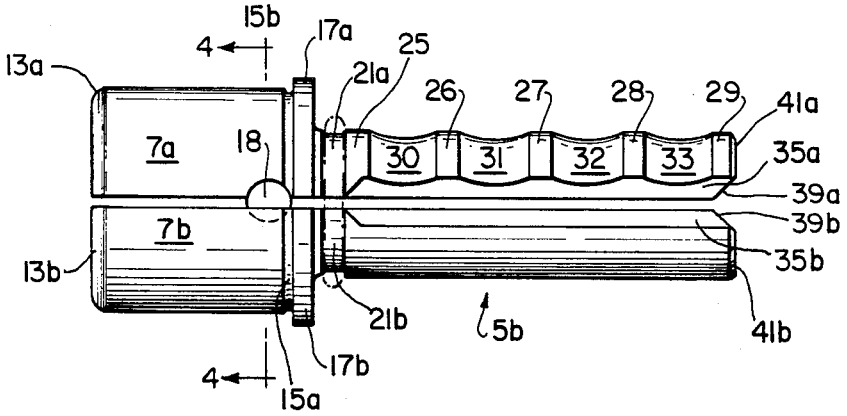
FIG. 3 is a side view of a portable chuck made in accordance with the invention.

With reference now to FIGS. 2 and 3, each of the spindle portions 7*a*, 7*b* of the chuck pieces 5*a*, 5*b* preferably includes a radius 13*a*, 13*b* around its distal end. Each of the spindle portions 7*a*, 7*b* also preferably includes a circumscribing groove 15*a*, 15*b* around the outside of its proximal end, as shown. Film core 3 usually includes a small ridge or upset 4 around its inner edge which is formed when the stock which forms such cores is cut. The radius 13*a*, 13*b* serve the important functions of facilitating the insertion of spindle portions 7*a*, 7*b* into the ends of tubular core 3 without shredding or flattening this ridge or upset 4. The preservation of this upset 4 in turn assists the circumscribing grooves 15*a*, 15*b* in the performance of their function, which is to receive the upset 4 when the spindle portions 7*a*, 7*b* are completely inserted into the end of core 3. As is best seen in FIG. 5, the receipt of upset 4 into the two circumscribing grooves 15*a*, 15*b* helps prevent the chuck 1 from falling out of the roll 2 of wrapping material when the roll 2 is vertically oriented.

The collars 17*a*, 17*b* located just under the spindle portions 7*a*, 7*b* of the chuck pieces 5*a*, 5*b* function both to limit the insertion of the spindle portions 7*a*, 7*b* into the tubular core 3 of the wrapping material 2, and to encourage the inner annular upset 4 of tubular core 3 to engage the grooves 15*a*, 15*b* when the chuck is "snugged" or wedged into the tubular core 3. In the preferred embodiment, the collar portions 17*a*, 17*b* are integrally formed with the chuck pieces 5*a*, 5*b*, respectively.

Figure 4:
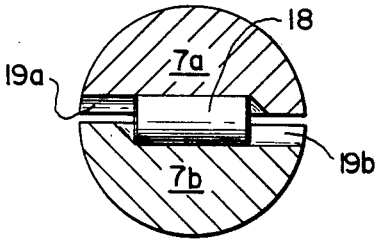
FIG. 4 is a cross-sectional view of the portable chuck illustrated in FIG. 3, taken along line 4—4.

With reference now to FIGS. 2 and 4, the two chuck pieces 5*a*, 5*b* are separated by a short dowel member 18 which forms a fulcrum means between the two chuck pieces 5*a*, 5*b*. Dowel member 18 allows the chuck pieces 5*a*, 5*b* to "rock" with respect to one another. The dowel member 18 is inserted between two semi-cylindrical, dowel-receiving bores 19*a*, 19*b* which are present in flat sides of the spindle portions 7*a*, 7*b*, respectively. The bores 19*a*, 19*b* are made in the same sides of the spindle portions 7*a*, 7*b* and preferably do not extend completely through the spindle portions 7*a*, 7*b*, so that the dowel member 18 will be "captured" between the two bores 19*a*, 19*b* when the two chuck pieces 5*a*, 5*b* are sandwiched together in the position illustrated in FIG. 4. It should be noted that this dowel-and-bore mechanical configuration not only functions to effectively secure the dowel member 18 within the chuck 1, but also functions to fit the chuck pieces 5*a*, 5*b* together and to maintain them in proper operational alignment with one another. It should also be noted that the dowel member 18, when placed above collars 17*a*, 17*b* as illustrated in FIG. 4, performs two other important functions. First, the dowel member 18 acts as a force amplifying fulcrum point which affords a great amount of mechanical advantage to the operator when he squeezes handle portions 20*a*, 20*b* to spread spindle portions 7*a*, 7*b* away from each other. Such mechanical advantage is due, of course, to the fact that the length of the distal ends of spindle portions 7*a*, 7*b* above the dowel member 18 is much shorter than the length of the handle portions 20*a*, 20*b*, collars 17*a*, 17*b*, and proximal end of the spindle portions 7*a*, 7*b* below dowel member 18. Second, the location of dowel member 18 just above the collars 17*a*, 17*b* gives the spindle of the chuck 1 a slightly "tapered" profile with a relatively narrow distal end and broad proximal end. This profile, in turn, facilitates the insertion of the spindle portions 7*a*, 7*b* into the end of tubular core 3, and allows the spindle portions to be snugged or wedged into the end of the core 3, thereby providing the chuck 1 with a second mechanism to help secure it into the film roll 2.

With reference now to FIG. 3, each of the chuck pieces 5*a*, 5*b* further includes a groove 21*a*, 21*b* circumscribing the tops of the handle portions 20*a*, 20*b*. These grooves 21*a*, 21*b* seat an elastomeric band 23. The band 23 provides a biasing means which biases the handle portions 20*a*, 20*b* of the chuck pieces 5*a*, 5*b* together. This in turn spreads the spindle portions 7*a*, 7*b* away from each other as a result of the "rocking" motion afforded the two chuck pieces 5*a*, 5*b* by dowel member 18. The spread-biased spindle portions 7*a*, 7*b* will lightly and frictionally engage the inner surface of the tubular core 3. This frictional engagement of the tube 3 by spindle portions 7*a*, 7*b* reinforces the chuck-securing function of the grooves 15*a*, 15*b*, and the tapered profile of the chuck spindle, and provides further insurance that the chuck will not fall out of the tubular core 3 when the roll 2 of wrapping material is vertically oriented. The elastomeric band 23, in conjunction with dowel member 18, also cooperates with the dowel-and-bore structure of the fulcrum of the chuck 1 in fitting and maintaining the two chuck pieces 5*a*, 5*b* together in proper operational alignment.

With reference now to FIGS. 2 and 3, the handle portions 20*a*, 20*b* of the chuck pieces 5*a*, 5*b* are differently fabricated in order to facilitate a manual grip onto the portable chuck 1, as well as to provide a tactile signal to the operator that the chuck halves 5*a*, 5*b* are properly oriented between his fingers and the palm of his hand. As will be described in more detail hereinafter, the operator must squeeze together the two adjacent handle portions 20*a*, 20*b* while the spindle of the chuck 1 is inserted into the tubular core 3 of the roll 2 if he is to properly "brake" the roll 2 by spreading apart spindle portions 7*a*, 7*b*. The handle portion 20*a* of chuck piece 5*a* includes a plurality of knurls 25, 26, 27, 28 and 29 which define a plurality of finger-receiving recesses 30, 31, 32 and 34. By contrast, the handle portion 20*b* of chuck piece 5*b* is smooth. When the operator feels the plurality of knurls 25, 26, 27, 28, and 29 between each of the fingers of his hand, and the smooth contour of handle portion 20*b* against the palm of his hand, he will know that the chuck is properly oriented in his hand for an effective tension controlling, braking action. Of course, the knurls 26, 27, 28 and 29 also function to facilitate the operator's grip onto the chuck 1, which is important in view of the fact that the chuck 1 and roll 2 are often vertically oriented during a wrapping operation.

Each of the handle portions 20*a*, 20*b* includes a pair of bevels 35*a*, 35*b* and 37*a*, 37*b* along each of their side edges, respectively. These bevels prevent the skin on the hand of the operator from being pinched between the flat adjacent sides of the handle portions 20*a*, 20*b* when the operator squeezes the handles to apply a braking force to the roll 2. Additionally, each of the handle portions includes a rear bevel 39*a* and 39*b*. These rear bevels may assist the operator in inserting the chuck 1 into the end of the roll 2 in a manner described in more detail hereinafter.

In operation, a pair of chucks 1 of the invention are inserted into the ends of the tubular core 3 of the roll of wrapping material 2, as indicated in FIG. 1. The chuck 1 is inserted into the tubular core by either spreading apart the handle portions 20*a*, 20*b* by inserting a finger into the space between the adjacent rear bevels 39*a*, 39*b*, or by squeezing together the two spindle portions 7*a*, 7*b*. When the distal ends of the spindle portions 7*a*, 7*b* come into contact, the cross-sectional area of the spindle of the chuck 1 is minimized. With the previously described assistance from the radii 13*a*, 13*b* on the distal ends of the spindle portions 7*a*, 7*b*, working in conjunction with the slightly "tapered" profile of the chuck spindle afforded by the high location of dowel member 18, the spindle of each chuck 1 is inserted and snugged or wedged into the end of the tubular core 3 until the collars 17*a*, 17*b* abut the end of core 3. In this position, the inner, annular upset 4 generally present around the inner edge of tubular core 3 engages the grooves 15*a*, 15*b* at the proximal ends of the spindle portions 7*a*, 7*b*, thereby conveniently securing the chuck 1 into the core 3. This securing action is reinforced by the action of elastomeric band 23, which tends to press the surfaces of the spindle portion 7*a*, 7*b* against the inner surface of the tubular core 3.

When the operator desirés to apply a braking action to the roll of wrapping material 2, he merely orients the knurls 25, 26, 27, 28, and 29 of handle portion 20*a* between his fingers and squeezes together the two handle portions 20*a*, 20*b* of the chuck 1. This squeezing action pivots the two chuck halves 5*a*, 5*b* against the dowel member 18, causing the spindle portions 7*a*, 7*b* to separate away from each other, and to frictionally engage the inner surface of tubular core 3. Spindle portions 7*a*, 7*b* are preferably dimensioned so that they fit with only a very small amount of clearance in their unexpanded position, so that when manual pressure is applied to the handle portions 20*a*, 20*b* the outer surfaces of the spindle portions 7*a*, 7*b* will completely and uniformly engage the adjacent portion of the inner surface of core member 3. As stated before, the location of dowel member 18 at the proximal ends of the spindle portions 7*a*, 7*b* maximizes the operator's leverage when he squeezes handle portions 20*a*, 20*b* to apply a braking force on the roll 2.

When the operator wishes to reduce the braking force, he merely loosens his grip on the handle portions 20*a*, 20*b* of the chucks, thereby allowing the natural resilience of the tubular core and the roll 2 of wrapping material to push the spindle portions 7*a*, 7*b* of the chuck back into the substantially non-engaging position illustrated in FIG. 5.

While the invention has been described in connection with a specific embodiment, it will be understood that it is capable of further modifications, and this application is intended to cover any variations, uses, or adaptations of the invention following in general the principles of the invention and including such departures from the present disclosure as come within known or customary practice within the art to which the invention pertains and as may be applied to the essential features hereinbefore set forth, and as fall within the scope of the appended claims.

What is claimed is:

1. A portable, manually operable chuck for dispensing under tension a roll of wrapping material wound about a tubular core, comprising:

(a) first and second adjacent chuck pieces, wherein each of said chuck pieces includes:

(i) a spindle portion insertable within one end of said tubular core for applying an infinitely adjustable braking force against said tubular core;

(ii) a collar connection to the proximal end of said spindle portion for limiting the insertion of said chuck piece into said tubular core to said spindle portion, and (iii) a handle portion connected to said collar which is longer than said spindle portion for providing both a handle for manipulating said roll of wrapping material when said spindle portion is inserted into one end of said tubular core, and a means for adjusting the amount of braking force applied to the tubular core of the wrapping material when said handle is manually grasped and squeezed by a single hand;

(b) a fulcrum means disposed between said adjacent chuck pieces above said collar of each for allowing said spindle portions to be spaced farther apart from one another with a mechanical advantage when said handle portions are manually squeezed together, whereby the braking force applied by the spindle portion against said tubular core is amplified; and (c) biasing means for biasing said handle portions toward one another so that said spindle portions will lightly frictionally engage the side wall of said core when said spindle portions are inserted in said core.

2. The portable chuck defined in claim 1, wherein said spindle portion is substantially semi-cylindrical.

3. The portable chuck defined in claim 1, wherein said tubular core includes an inner edge having an upset, and wherein the outside of said spindle portion is circumscribed by a groove at its proximal end for receiving said upset.

4. The portable chuck defined in claim 1, wherein said biasing means includes an elastic band circumscribing both said handle portions of said chuck pieces for both biasing said chuck pieces together, and for maintaining a functional alignment between said chuck pieces by resisting all relative motion between said pieces except for said rocking motion.

5. The portable chuck defined in claim 2, wherein said fulcrum means includes an elongated member receivable into a pair of opposing recesses in said first and second adjacent chuck pieces, respectively, for both providing a fulcrum point between said pieces and maintaining said pieces in proper functional alignment by resisting all relative movement between said chuck pieces except for said rocking motion.

6. The portable chuck defined in claim 5, wherein said elongated member has a substantially round cross-section.

7. The portable chuck defined in claim 1, wherein said spindle portion of each chuck piece is radiused on its distal end to faciliate the insertion of said spindle portion into said core.

8. The portable chuck defined in claim 1, wherein the handle portion of at least one of the chuck pieces includes a plurality of finger ridges for facilitating a manual grip on the chuck, and for providing a tactile signal to an operator when the handle portion off the chuck pieces are properly situated in the hand of said operator for proper operation.

9. The portable chuck defined in claim 1, wherein said adjacent spindle portions are dimensioned so that substantially the entire semi-cylindrical surface of each engages a portion of the interior surface of said tubular core when said handle portions are biased toward one another.

10. The portable chuck defined in claim 9, wherein said adjacent spindle portions are dimensioned so that each portion of the entire semi-cylindrical surface of each chuck engages a portion of the interior surface of said tubular core with substantially the same pressure when said handle portions are biased toward one another.

11. The portable chuck defined in claim 1, wherein the side edges of said handle portion of each chuck piece is beveled to prevent the skin of an operator's hand from being pinched when said operator manually squeezes said handle portions together.

12. A portable, manually operable chuck for dispensing under tension a roll of wrapping material wound about a tubular core having an upset circumscribing the inner edge, comprising:

(a) first and second adjacent chuck pieces, wherein each of said chuck pieces includes:

(i) a spindle portion insertable within one end of said tubular core for applying an infinitely adjustable braking force against said tubular core, wherein said spindle portion is circumscribed by a groove at its proximal end for receiving said upset on said inner edge of said tube;

(ii) a collar connected to the proximal end of said spindle portion for limiting the insertion of said chuck piece into the tubular core to said spindle portion, and (iii) a handle portion connected to said collar which is longer than said spindle portion for providing both a handle for manipulating said roll of wrapping material when said spindle portion is inserted into one end of said tubular core, and a means for adjusting the amount of braking force applied to the tubular core of the wrapping material when said handle is manually grasped and squeezed by a single hand, and (b) a fulcrum means disposed between said adjacent chuck pieces above said collar of each for allowing said spindle portions to be spaced farther apart from one another with a mechanical advantage when said handle portions are manually squeezed together, wherein said fulcrum means includes an elongated member receivable into a pair of opposing recesses in said first and second adjacent chuck pieces, respectively, for both providing a fulcrum point between said pieces and for maintaining said pieces in proper functional alignment by resisting all relative movement between said chuck pieces except for said rocking motion.

* * * * *